US008459070B2

(12) United States Patent
Johnson et al.

(10) Patent No.: US 8,459,070 B2
(45) Date of Patent: Jun. 11, 2013

(54) COMBINATION LOCKS WITH IMPROVED CODE-CHANGING FEATURES

(75) Inventors: Mark D. Johnson, Hubertus, WI (US); Rafael Hiram Gutierrez Medina, Nogales Sonora (MX)

(73) Assignee: Master Lock Company LLC, Oak Creek, WI (US)

( * ) Notice: Subject to any disclaimer, the term of this patent is extended or adjusted under 35 U.S.C. 154(b) by 73 days.

(21) Appl. No.: 13/036,295

(22) Filed: Feb. 28, 2011

(65) Prior Publication Data

US 2011/0209506 A1 Sep. 1, 2011

Related U.S. Application Data

(60) Provisional application No. 61/309,063, filed on Mar. 1, 2010.

(51) Int. Cl.

| | |
|---|---|
| ***B65D 55/14*** | (2006.01) |
| ***E05B 37/00*** | (2006.01) |
| ***E05B 37/04*** | (2006.01) |
| ***E05B 37/08*** | (2006.01) |

(52) U.S. Cl.
USPC ..... 70/63; 70/303 R

(58) Field of Classification Search
USPC ..... 70/301–306, 309, 310, 312, 329, 70/332, 333 R, 327, 328, 292, 293, 443–445, 70/DIG. 44, 311
See application file for complete search history.

(56) References Cited

U.S. PATENT DOCUMENTS

| | | | | |
|---|---|---|---|---|
| 2,477,182 | A | 7/1949 | Hosking | |
| 3,190,089 | A | 6/1965 | Foote et al. | |
| 3,611,761 | A * | 10/1971 | Atkinson | 70/129 |
| 3,799,594 | A * | 3/1974 | Watermann | 292/213 |
| 4,308,731 | A | 1/1982 | Remington | |
| 4,376,380 | A * | 3/1983 | Burgess | 70/303 A |
| 6,131,428 | A * | 10/2000 | Wildman | 70/301 |
| 6,401,505 | B1 | 6/2002 | Kajuch et al. | |
| 6,904,778 | B2 | 6/2005 | Jasper | |
| 7,984,630 | B2 * | 7/2011 | Peot et al. | 70/135 |
| 2004/0182120 | A1 * | 9/2004 | Flory et al. | 70/134 |
| 2008/0173049 | A1 * | 7/2008 | Burmesch et al. | 70/25 |
| 2008/0209962 | A1 * | 9/2008 | Peot et al. | 70/101 |
| 2009/0223258 | A1 * | 9/2009 | Burmesch et al. | 70/25 |
| 2009/0282879 | A1 * | 11/2009 | Marcelle et al. | 70/277 |

OTHER PUBLICATIONS

International Search Report and Written Opinion from PCT Application No. PCT/US2011/026421 dated Apr. 25, 2011.

* cited by examiner

*Primary Examiner* — Suzanne Barrett
*Assistant Examiner* — Myles Throop
(74) *Attorney, Agent, or Firm* — Calfee, Halter & Griswold LLP

(57) ABSTRACT

A combination locking arrangement includes a locking member, a locking lever connected to the locking member; and at least first and second tumbler discs rotatable about a tumbler disc axis. When each of the tumbler discs is rotated to an unlocking orientation, the locking lever engages aligned recesses in the tumbler discs, such that further rotation of the tumbler discs moves the locking member from the locking position to the releasing position. A dial is rotatable about the tumbler disc axis for selective rotation of the tumbler discs, and includes a drive portion rotationally secured in interlocking engagement with the first tumbler disc in one of a plurality of code selecting orientations. The locking lever includes a disc securing portion positioned to prevent axial disengagement of the first tumbler disc from the dial drive portion when the locking lever is engaged with the aligned recesses in the tumbler discs.

20 Claims, 11 Drawing Sheets

COMBINATION LOCKS WITH IMPROVED CODE-CHANGING FEATURES

CROSS-REFERENCE TO RELATED APPLICATION

This application claims the benefit of U.S. Provisional Patent Application Ser. No. 61/309,063, entitled COMBINATION LOCKS WITH IMPROVED CODE-CHANGING FEATURES and filed Mar. 1, 2010, the entire disclosure of which is incorporated herein by reference.

BACKGROUND

Combination locks are used in a variety of applications, including, for example, with enclosures such as lockers, storage sheds, and various gates and doors. The locking mechanism of a conventional single dial combination lock 1 is schematically illustrated in FIG. 1. A numbered combination dial 2, which serves as the user interface, is positioned on an external surface of the lock 1. Rotation of the dial causes a drive plate 3 to engage a series of rotating tumbler disc 4*a*, 4*b*, 4*c* (usually three for a conventional combination padlock or school locker lock), each having an outer periphery which holds a lever or fence 7 in a locking condition. Detents or lugs 9 extending from each of the tumbler discs 4*a*, 4*b*, 4*c* engage each other to cause the tumbler discs 4*a*, 4*b*, 4*c* to rotate together. The innermost tumbler disc 4*a* may, but need not, be rotationally fixed to the drive plate 3.

When the dial 2 is rotated to a first desired rotational position and then rotated in an opposite direction (for example, the counterclockwise direction), the outermost or third tumbler disc 4*c* remains in a desired rotational position due to separation from the detent 9 of the middle or second tumbler disc 4*b*. When the dial is then rotated to a second desired rotational position and then rotated in an opposite direction (for example, the clockwise direction), the second tumbler disc 4*b* remains in a desired rotational position due to separation from the detent 9 of the innermost or first tumbler disc 4*a*. When the dial 2 is then rotated to a third desired rotational position, the first tumbler disc 4*a* is positioned accordingly. In this fashion, the dial 2 may be rotated to successive desired positions (identifiable by alignment numbers on the dial 2, with a detent, notch, or other indicator on the lock housing) that align notches 6 in each of the tumbler discs 4*a*, 4*b*, 4*c* with the lever 7.

When all of the notches 6 are aligned with the lever 7, the lever may be permitted to move into the aligned notches 6 (for example, by user movement or by a spring loaded mechanism). In one embodiment, this lever movement may allow a locking member 5 to move out of locking engagement with a locked obstruction, such as, for example, a shackle, to allow withdrawal of the shackle. In another embodiment, engagement of the lever 7 with the aligned notches 6 may allow lateral movement of the lever 7 and a connected locking member 5 (e.g., a slideable locking bolt) by continued rotation of the combination dial 2 and the engaged tumbler discs 4*a*, 4*b*, 4*c* beyond the third successive desired rotational position, for retraction of the locking bolt to disengage a corresponding locking component (e.g., a locker frame or an interengaging latch).

While the use of a combination lock, as compared to a key based lock, may eliminate the risk of lost, stolen, or copied keys, an authorized combination may still be learned by an unauthorized user, or known by a once-authorized user to whom access is no longer desired (e.g., when a locker is assigned to a different student in a subsequent school year). In these and other circumstances, an authorized user or administrator may wish to change the unlocking combination. In a conventional combination lock, the authorized combination code may be changed to one of several optional combination codes by axially separating the drive plate from the first, innermost tumbler disc, such that the rotational position of the dial and drive plate with respect to the first tumbler disc may be adjusted. This results in a change in the numerical permutations of the authorized combination code.

SUMMARY

According to an aspect of the present application, a combination lock may be provided with two or more tumbler discs rotatable to an unlocking orientation in which a locking lever engages the tumbler discs, such that further rotation of the discs drives the locking lever and a connected locking member to a releasing condition. To prevent the tumbler discs from axially disengaging from a drive portion of the dial during driving rotation of the tumbler discs, the locking lever may be provided with a disc securing portion positioned to prevent axial disengagement of the tumbler discs from a drive portion of the dial when the locking lever is engaged with the tumbler discs.

Accordingly, in one embodiment, a combination locking arrangement includes a locking member, a locking lever connected to the locking member; and at least first and second tumbler discs rotatable about a tumbler disc axis. When each of the tumbler discs is rotated to an unlocking orientation, the locking lever engages aligned recesses in the tumbler discs, such that further rotation of the tumbler discs moves the locking member from the locking position to the releasing position. A dial is rotatable about the tumbler disc axis for selective rotation of the tumbler discs, and includes a drive portion rotationally secured in interlocking engagement with the first tumbler disc in one of a plurality of code selecting orientations. The locking lever includes a disc securing portion positioned to prevent axial disengagement of the first tumbler disc from the dial drive portion when the locking lever is engaged with the aligned recesses in the tumbler discs.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes embodiments of the invention and is not intended to limit the scope of the claims in any way. Indeed, the invention as claimed is broader than and unlimited by the preferred embodiments, and the terms used in the claims have their full ordinary meaning. For example, while the specific embodiments described herein relate to combination locker locks, the inventive aspects of the present application may additionally or alternatively be applied to other combination lock arrangements, including, for example, combination padlocks and combination safes.

Figure 4:
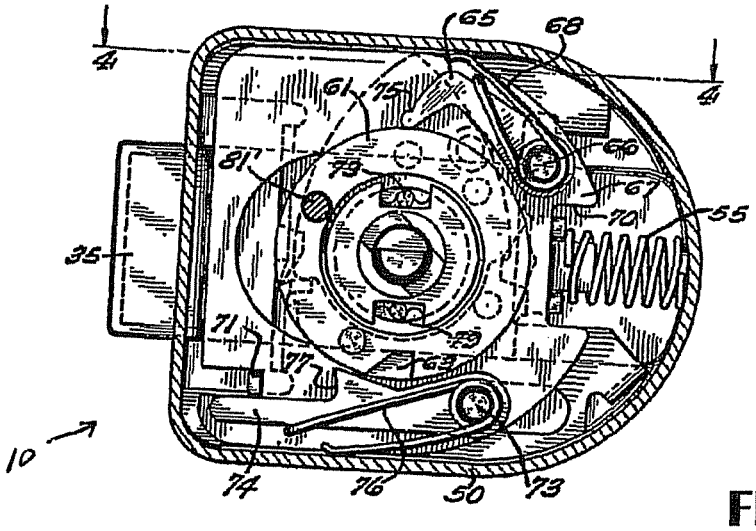
FIG. 4 PRIOR ART
FIG. 4 is a front cross-sectional view of the locker lock of FIG. 2.
Figure 5:
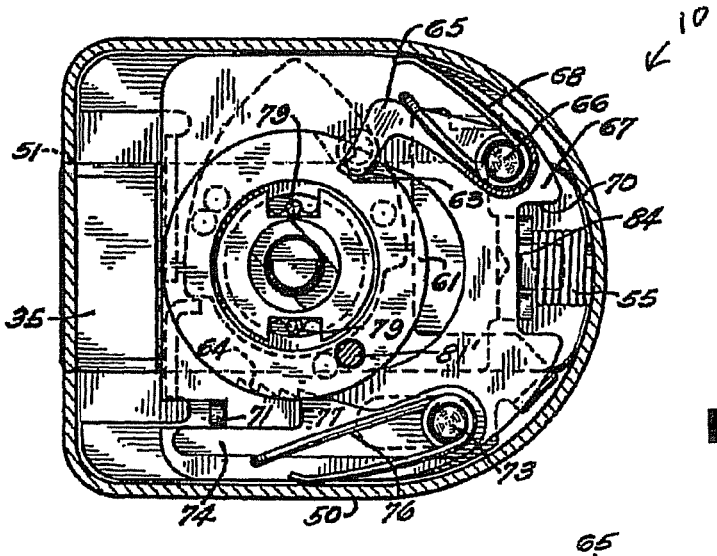
FIG. 5 PRIOR ART
FIG. 5 is a front cross-sectional view of the locker lock of FIG. 2, shown in a combination dial-operated unlocked condition.

A conventional combination locker lock having a single-dial locking arrangement and a key-operated locking and code change arrangement is described in U.S. Pat. No. 3,190,089 (the "'089 patent"), the entire disclosure of which is incorporated by reference herein, to the extent that it is not conflicting with the present application. In this conventional combination locker lock 10, as shown in FIGS. 2-7, the dial 36 is sequentially rotatable to three successive rotatable positions to rotate three tumbler discs 61, 61' (via clutch plate 46) into unlocking orientations in which notches 63, 63' (FIGS. 4-7) in each of the discs 61, 61' align with a spring-loaded lever 65, such that the lever 65 pivots about a pivot pin 66 (FIGS. 4-7) into engagement with the aligned notches 63, 63'. In other embodiments, a different number of tumbler discs may be utilized. The lever 65 is connected with a retainer plate 67, such that further rotation of the combination dial 36 beyond the third successive rotational position causes the first tumbler disc 61 to push the engaged lever 65 and retainer plate 67 (FIG. 5). The sliding movement of the retainer plate 67 in turn forces the locking bolt 35 into a retracted or unlocked position, as shown in FIG. 5, to allow the locker door to be opened. When the dial 36 is released, a spring 55 forces the locking bolt 35 back to the extended or locked position (FIG. 4).

Figure 6:
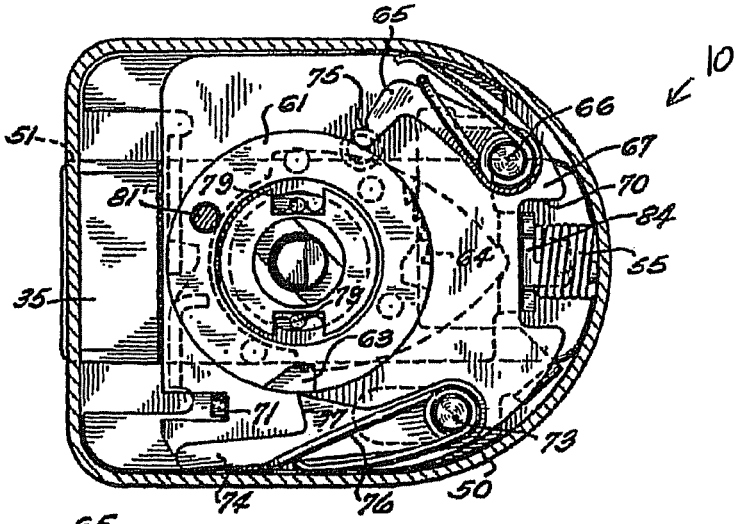
FIG. 6 PRIOR ART
FIG. 6 is a front cross-sectional view of the locker lock of FIG. 2, shown in a key-operated unlocked condition.
Figure 7:
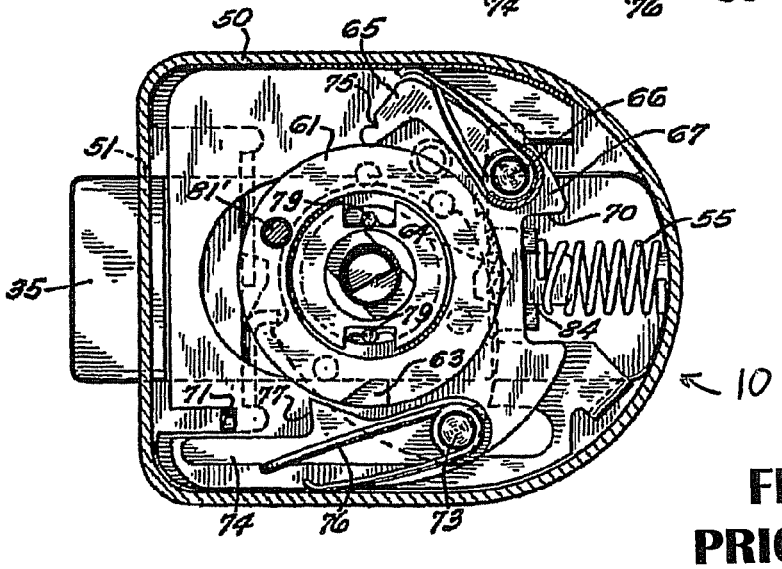
FIG. 7 PRIOR ART
FIG. 7 is a front cross-sectional view of the locker lock of FIG. 2, shown in a key-operated combination change condition.
Figure 8:
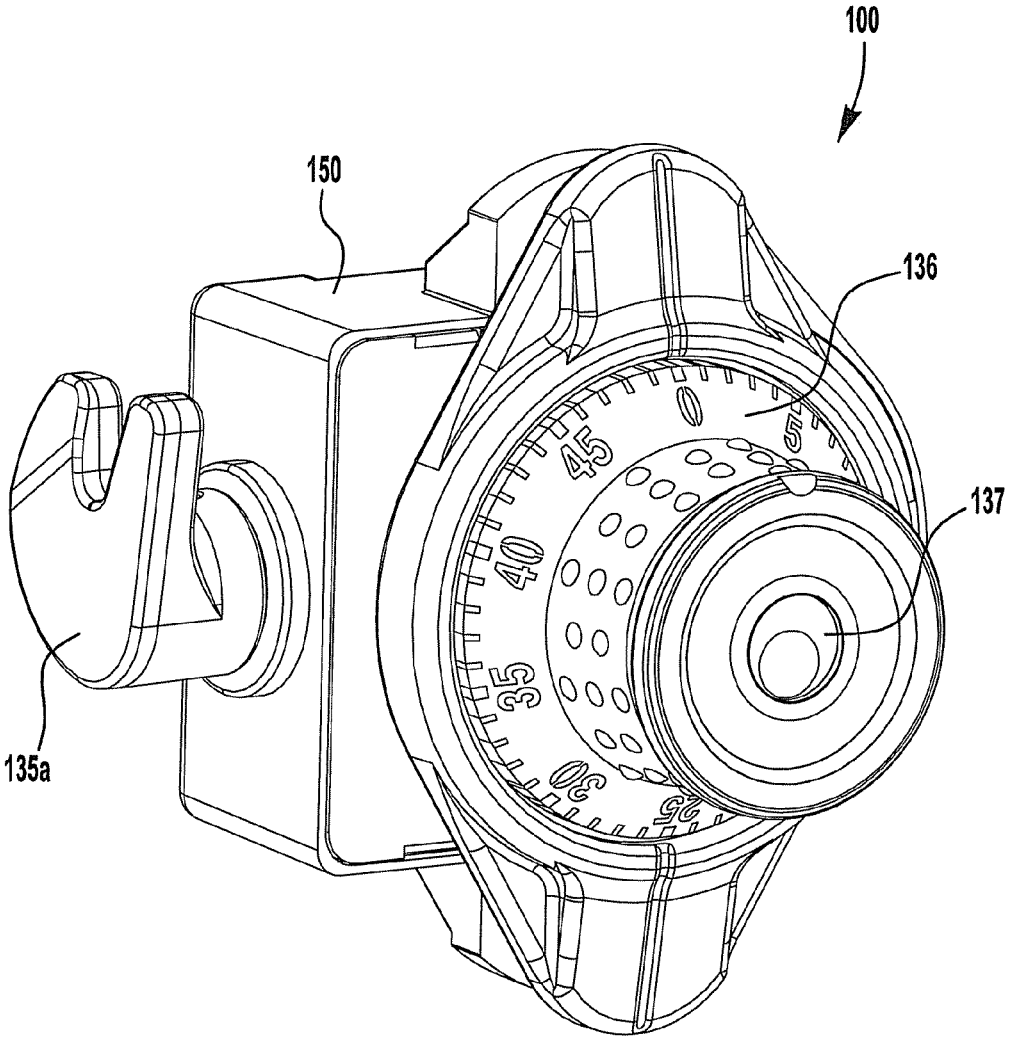
FIG. 8 is a perspective view of a combination locker lock.
Figure 8A:
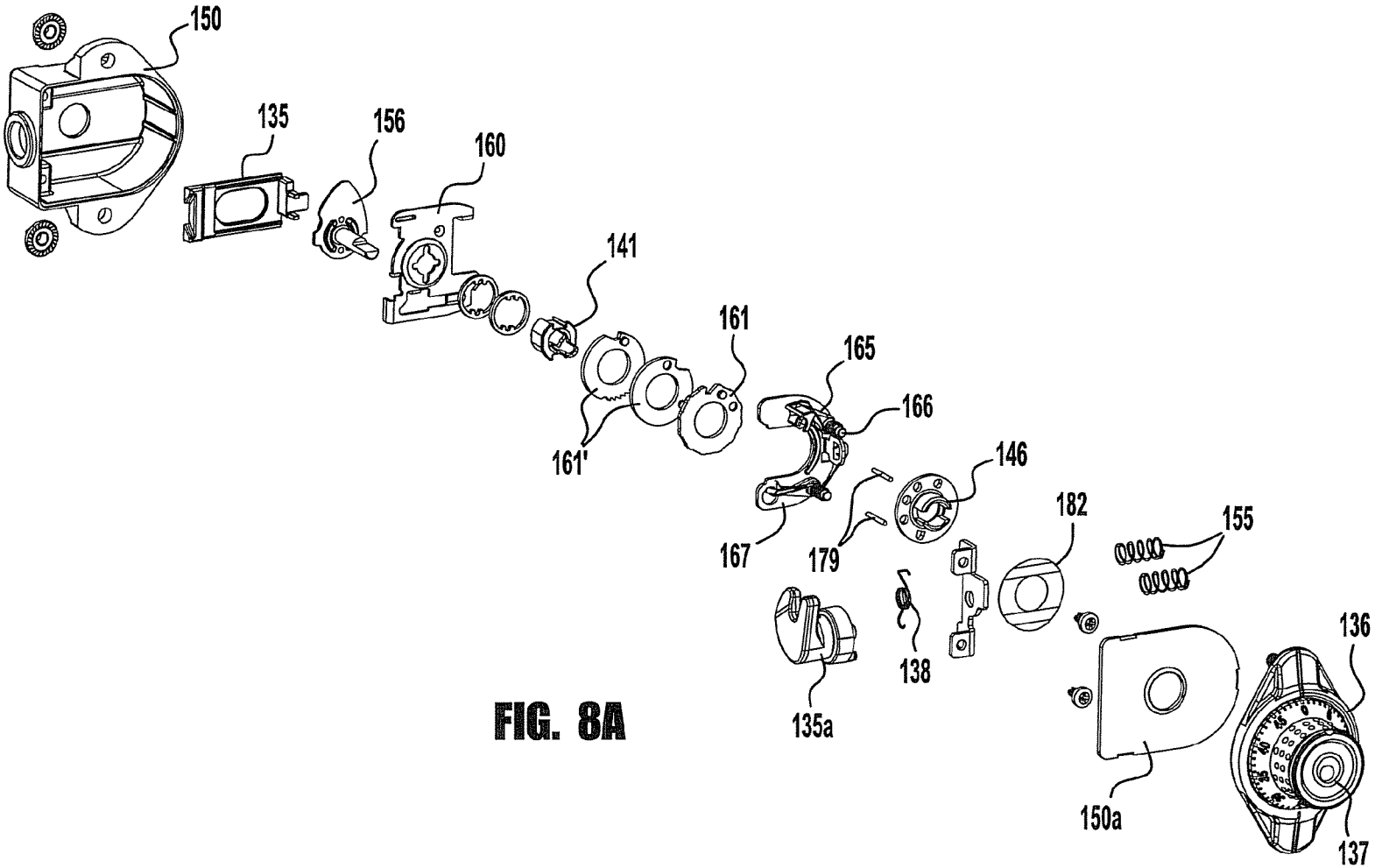
FIG. 8A is an exploded perspective view of the locker lock of FIG. 8.
Figure 9:
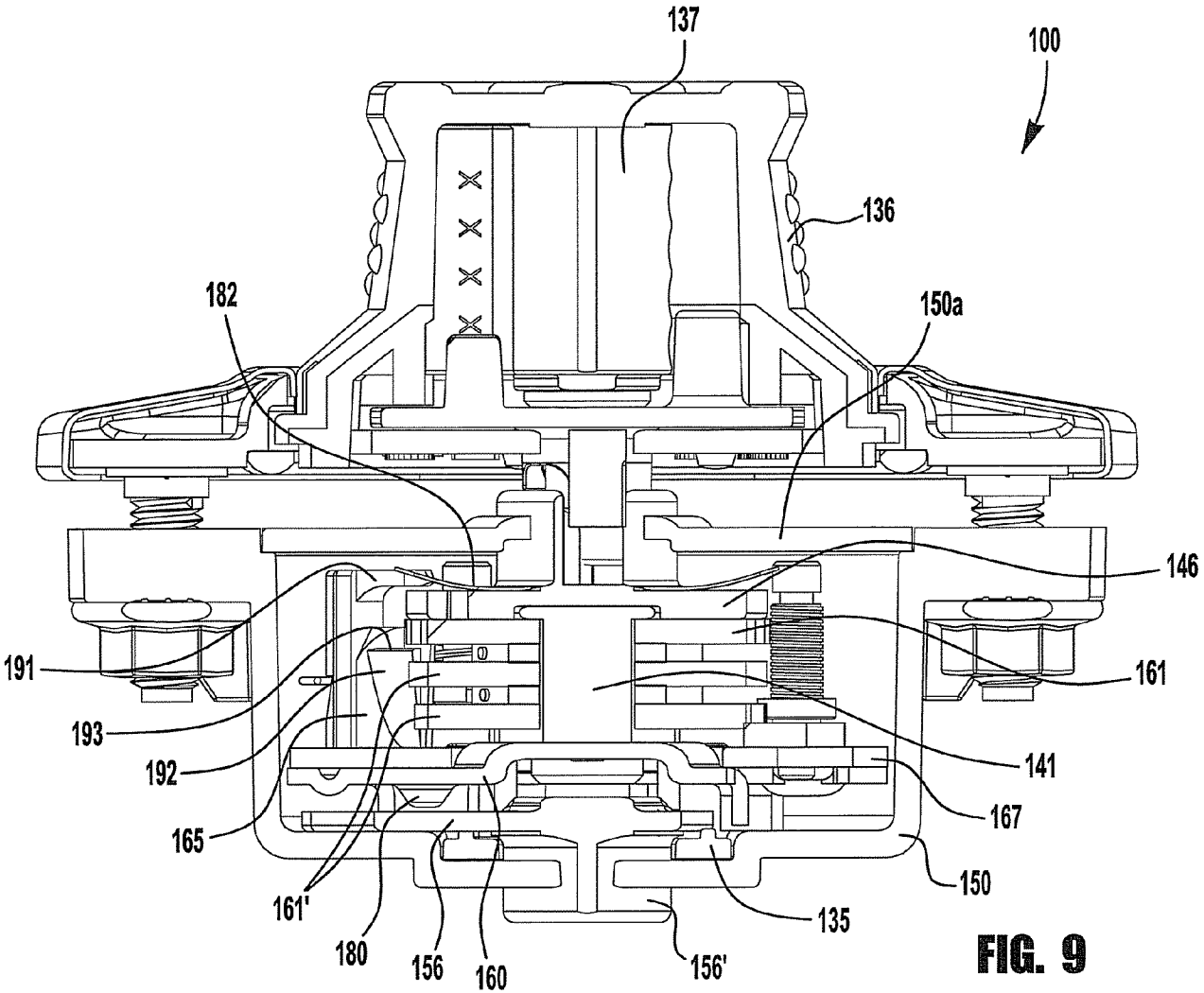
FIG. 9 is a side cross-sectional view of the locker lock of FIG. 8.
Figure 10:
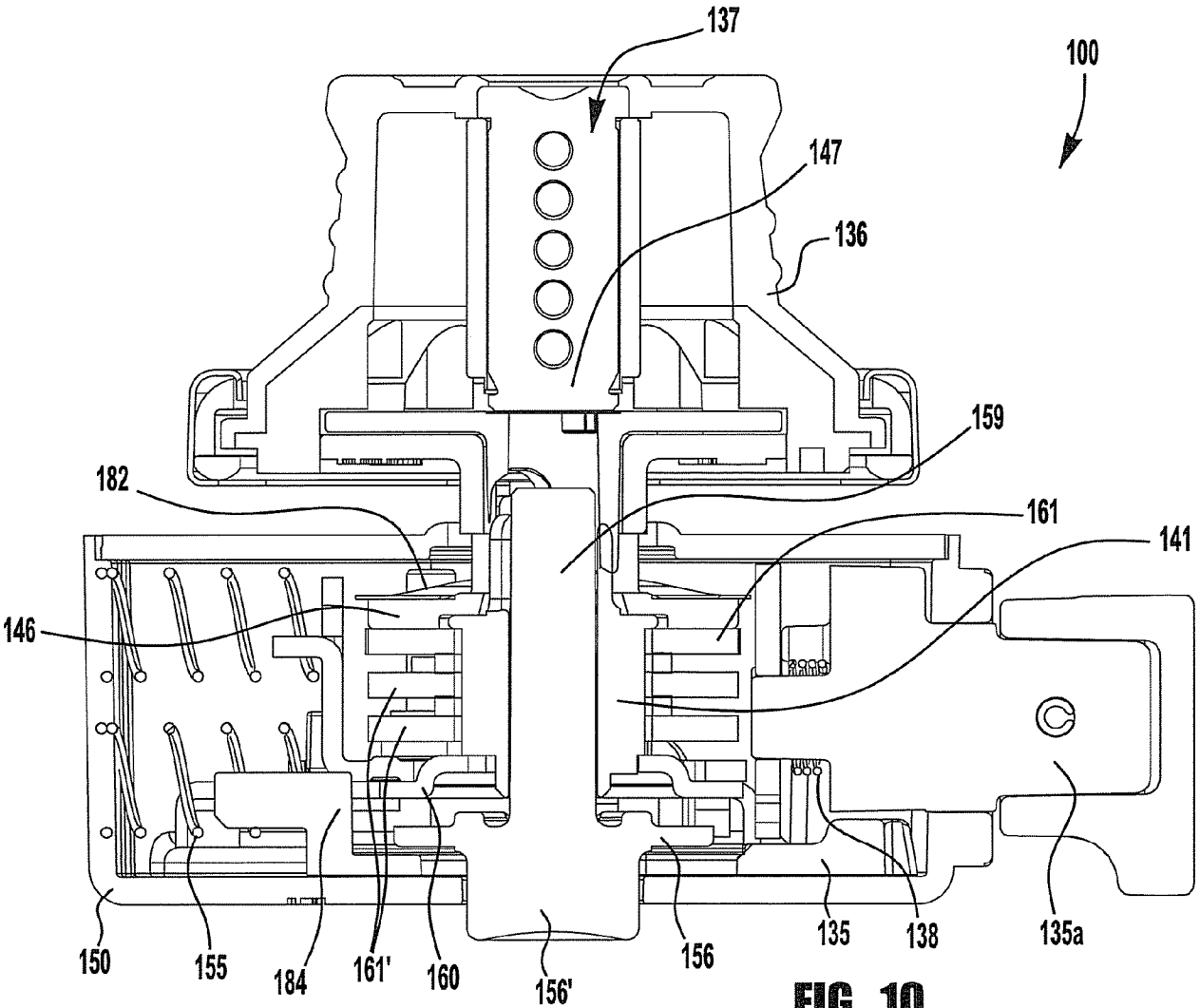
FIG. 10 is a top cross-sectional view of the locker lock of FIG. 8.
Figure 11:
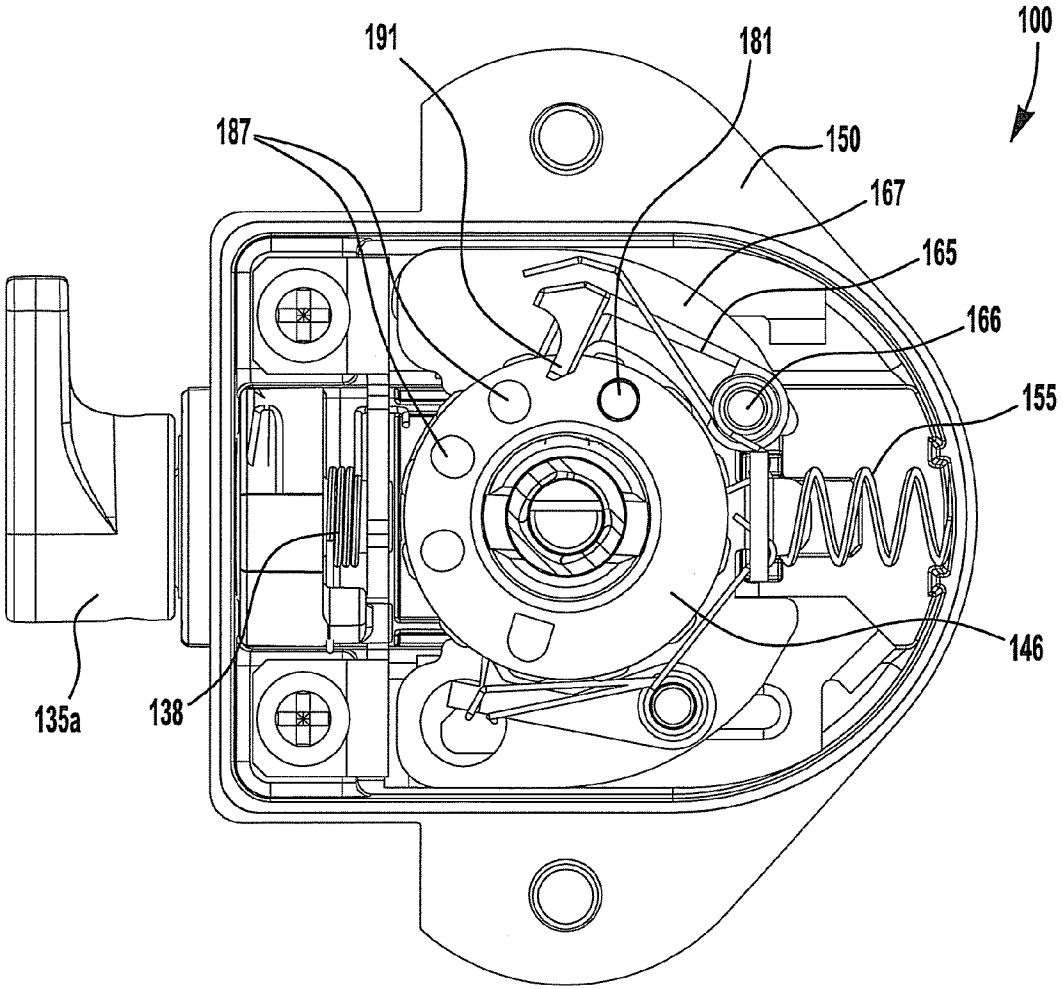
FIG. 11 is a front cross-sectional view of the locker lock of FIG. 8.

To provide for key operation of the combination locker lock 10, a conventional lock cylinder 37 includes a plug 47 rotationally fixed to an extension 59 (FIG. 2), which is secured to a cam 56. When the plug 47 is rotated by an authorized key 49, the cam 56 rotates such that an elongated portion (shown in phantom in FIGS. 4-7) of the cam engages a flange 84 of the locking bolt 35 to move the locking bolt 35 to the retracted position (FIG. 6).

Figure 1:
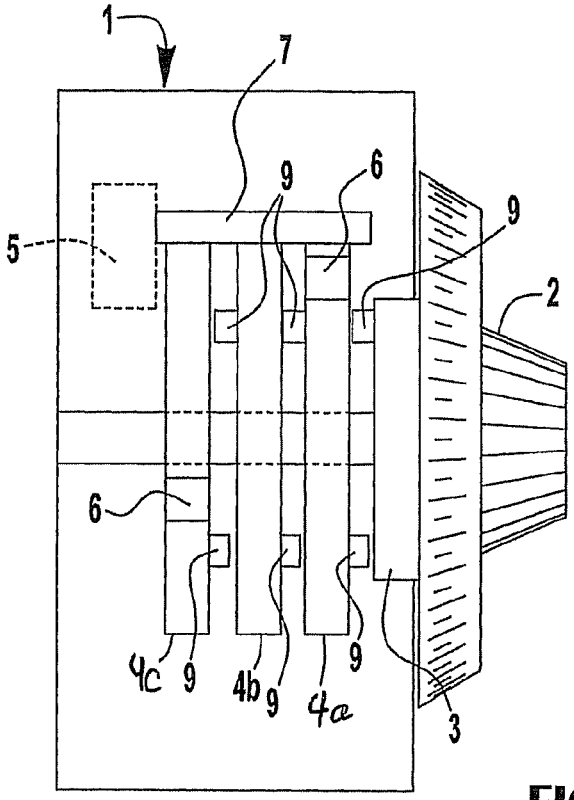
FIG. 1 PRIOR ART
FIG. 1 is a schematic side cross-sectional view of a combination lock.
Figure 2:
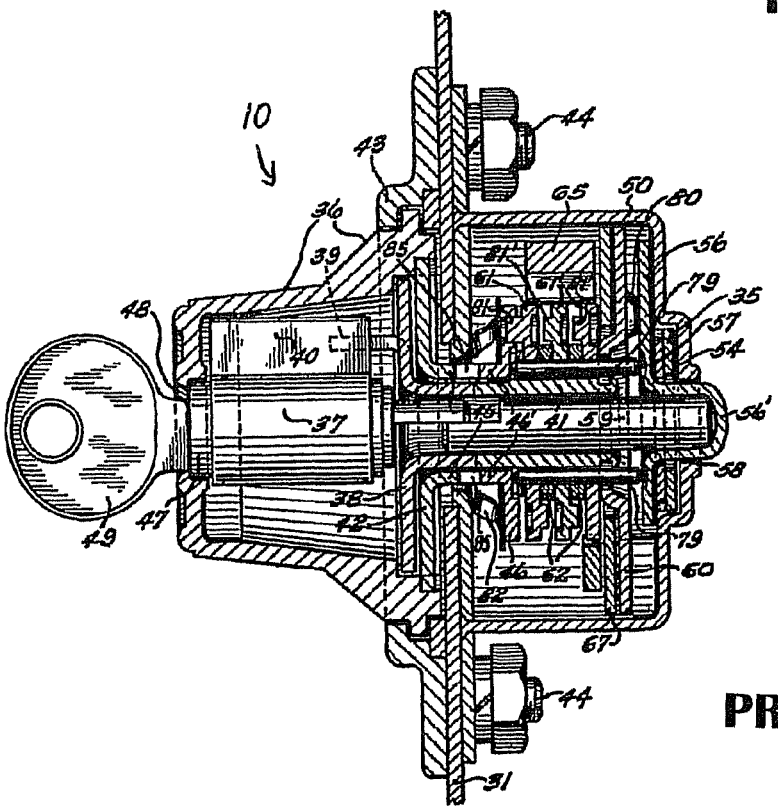
FIG. 2 PRIOR ART
FIG. 2 is a side cross-sectional view of a conventional combination locker lock.
Figure 3:
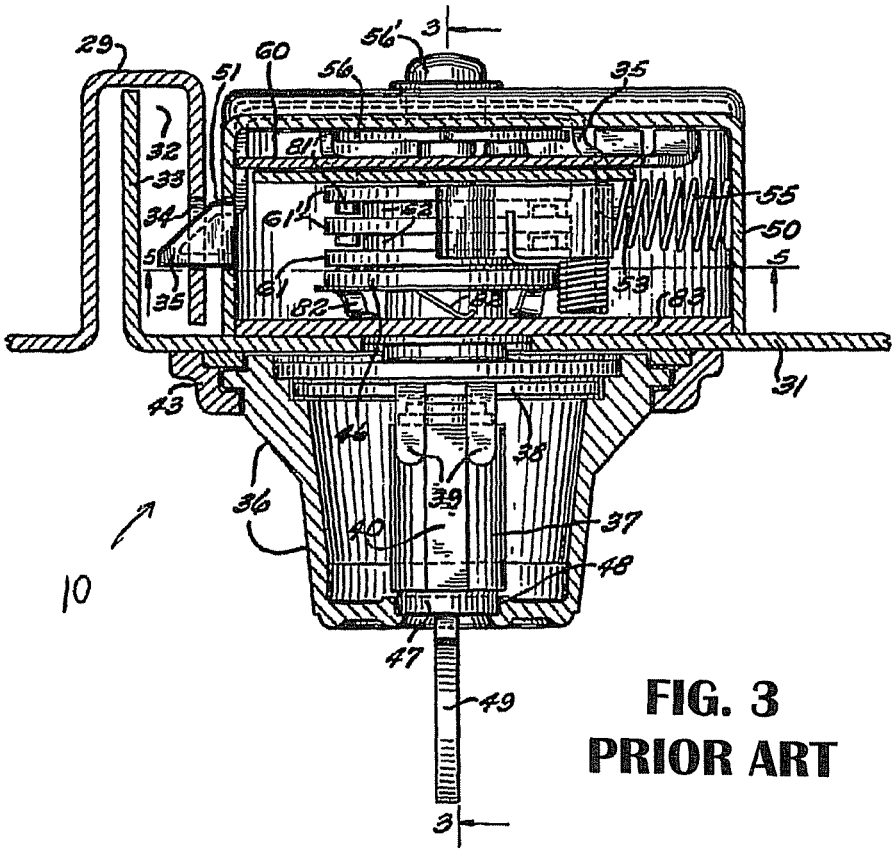
FIG. 3 PRIOR ART
FIG. 3 is a top cross-sectional view of the locker lock of FIG. 2.

To effect a combination code change of the lock 10, rotation of the lock cylinder plug 47 and cam 56 beyond the unlocked position (FIG. 7) causes ramped surfaces of the cam 56 to axially raise pins 79 (FIG. 2) toward engagement with the clutch plate 46. Additionally, the elongated portion of the cam 56 is rotated out of alignment with a protuberance 80 on a bottom plate 60 within the lock (FIG. 2). This cam rotation allows a button portion 56' of the cam 56 to be pressed to axially slide the pins 79 against the clutch plate 46 and spring washer 82 (FIGS. 2 and 3) for disengagement of the clutch plate 46 from a lug 81 of the first tumbler disc 61 (FIG. 2). Subsequent rotation of the dial 36 rotates the clutch plate 46 with respect to the first tumbler disc 61 for alignment of the lug 81 with one of several apertures in the clutch plate 46. Releasing the button portion 56' with the dial and clutch plate in this new orientation causes the spring washer 82 to force the lug 81 into engagement with a new aperture in the clutch plate 46, such that different numbers on the combination dial 36 are associated with each of the successive rotational positions selected to effect unlocking alignment of the tumbler discs 61, 61'. When the key cylinder lug 47 is rotated back to the normal locked position, the spring washer 82 returns the clutch plate 46 and pins 79 to their normal positions, with the protuberance 80 aligning with the elongated portion of the cam 56 to block depression of the button portion 56'.

To overcome the biasing force of the spring 55, increased rotational force must be applied to the dial 36 to retract the locking bolt 35 after the successive rotational positions of the dial have been achieved. Various loose fits, tolerances, or "play" between the internal components of this conventional combination locking mechanism may result in unintended separation of the clutch plate 46 from the first tumbler disc 61 upon application of this increased rotational force, resulting in subsequent re-engagement of the clutch plate with the tumbler disc in a different rotational orientation. This unintended code change is likely to present difficulties for the authorized user, as the resulting new combination code is unlikely to be known. For example, axial play inherent in the engagement of the clutch plate 46 with the first tumbler disc 61 may result in forced separation if one or both of the clutch plate 46 and tumbler disc 61 are cocked at a slight angle. As another example, angular play of the pivot pin 66 may angle the lever 65 such that the first tumbler disc 61 rides up the edge of the lever 65 during forced movement of the lever, which may knock the clutch plate 46 out of engagement with the tumbler disc 61.

According to an inventive aspect of the present application, a single dial combination lock with a key operated code changing arrangement may be adapted to prevent unintentional separation of a clutch plate from a first or innermost tumbler disc during combination dial retraction of the locking bolt, such that unintended combination changes are avoided. In one embodiment, the combination lock may be configured such that the clutch plate and first or innermost tumbler disc are axially fixed or captured within the lock when the locking bolt is moved from the extended position to the retracted position by the combination dial. For example, a pivotable lever may be configured to axially capture one or both of the clutch plate and the innermost tumbler disc when the lever engages aligned notches in the tumbler discs. When the lever is in a normal non-pivoted position, the axially capturing portion of the lever is positioned laterally outward of the clutch plate and tumbler disc, such that the clutch plate may be axially separable, for example, by a key-operated code change mechanism. Further, because the relatively loose and unhindered normal rotation of the combination dial is unlikely to present a risk of axial separation of the clutch plate and tumbler disc, the axial capture of the clutch plate and tumbler disc in this condition need not (but may) be provided.

FIGS. 8-13 illustrate various views of a locker lock 100 adapted to prevent inadvertent combination code changes during forced movement of a locking bolt 135 (or other such locking member) by rotation of a combination dial 136 secured to the exterior of the lock housing 150, 150*a*. As illustrated, many of the features and components of the inventive embodiment may, but need not, be consistent with features and components of the conventional locker lock 10 of FIGS. 2-7, as described above and more fully described in the incorporated specification of the '089 patent. While the locker lock may be configured to lock by engagement of a sliding locking bolt with a locker frame member (as is the case with the locker lock 10 of FIGS. 2-7), in the illustrated embodiment, the locking mechanism includes a locking bolt 135 that is disposed entirely within the lock housing 150, 150*a*, and is laterally movable or retractable to disengage a rotary latch 135a (FIGS. 8, 10, 11, and 13) for spring-loaded rotation (by spring 138) of the latch 135*a* to an unlocked position. Another example of a combination locker lock with rotary latch is described in co-pending U.S. Application Pub. No. 2008/0209962, entitled LOCKER LOCK, the entire disclosure of which is incorporated herein by reference, to the extent that it is not conflicting with the present application.

As with the conventional combination locker lock 10 of FIGS. 2-7, the dial 136 is sequentially rotatable to three successive rotatable positions to selectively rotate three tumbler discs 161, 161' via a drive portion or clutch plate 146 that interlocks with the first tumbler disc 161 for fixed rotation therewith. The tumbler discs 161, 161' are rotatable about an extension or post 141 into unlocking orientations in which notches or recesses 163, 163' (FIG. 13) in each of the discs 161, 161', align with a spring-loaded locking lever 165 that is pivotally biased against the tumbler discs. Upon alignment, the locking lever 165 pivots about a pivot pin 166 into engagement with the aligned notches 163, 163'. The lever 165 is connected with a locking bolt 135 by a retainer plate 167 (FIGS. 9 and 11), such that further rotation of the combination dial 136 beyond the third successive rotational position causes the first tumbler disc 161 to push the engaged lever 165 and retainer plate 167. The sliding movement of the retainer plate 167 in turn forces the locking bolt 135 from a locking position into a retracted or releasing position to allow for spring loaded rotation of the rotary latch 135*a*. When the dial 136 is released and the rotary latch 135*a* is manually rotated back to a locked position, a spring 155 (FIGS. 10 and 11) forces the locking bolt 135 back to the extended or locked position.

To provide for key operation of the combination locker lock 100, a lock cylinder 137 includes a plug 147 rotationally fixed to an extension 159 (FIG. 10), which is secured to a camming member 156. When the plug 147 is rotated by an authorized key, the camming member 156 rotates such that an elongated portion of the camming member 156 (FIGS. 9 and 12) engages a flange 184 of the locking bolt 135 to move the locking bolt 135 to the retracted position.

Figure 12:
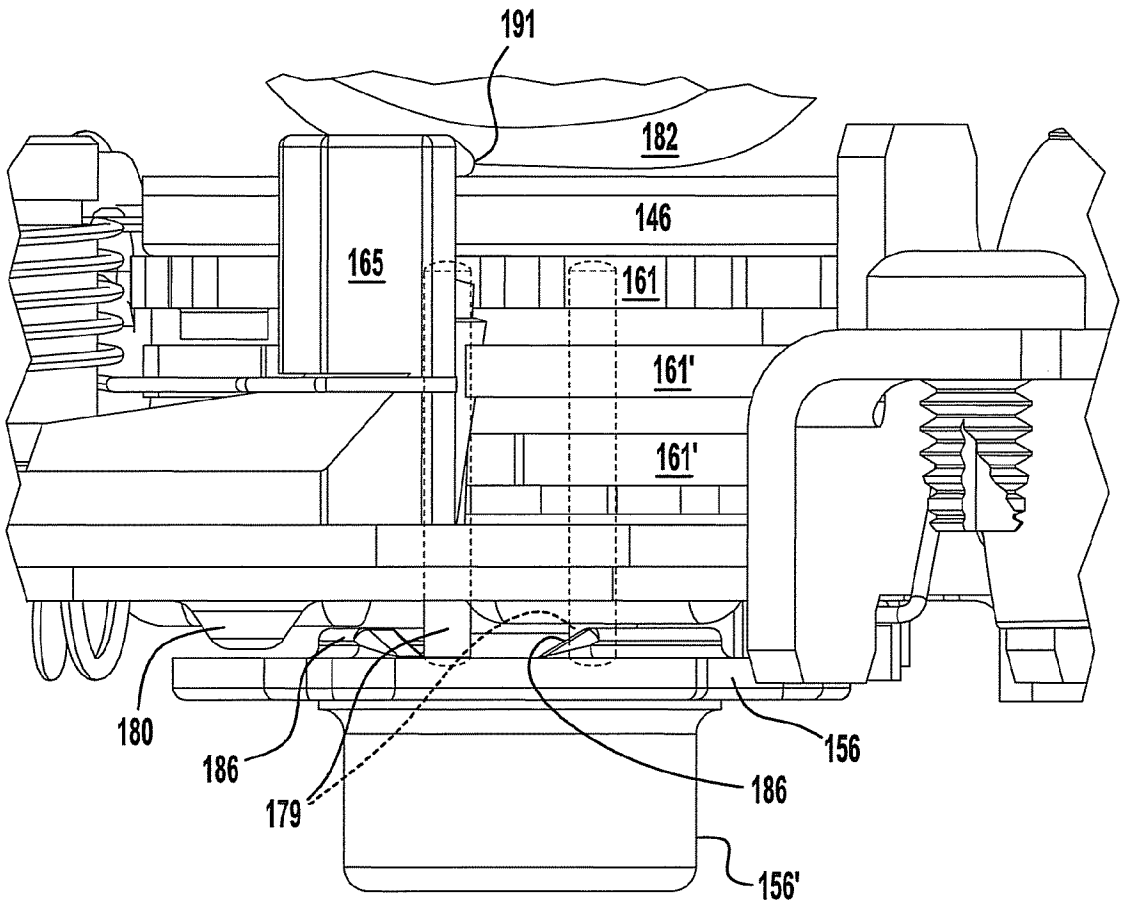
FIG. 12 is a partial perspective view of the locker lock of FIG. 8, with portions of the lock removed to illustrate additional features of the locker lock.

To effect a combination code change of the lock 100, rotation of the lock cylinder plug 147 and camming member 156 to the unlocked position provides a code change condition in which ramped surfaces 186 of the camming member 156 axially raise pins 179 toward engagement with the clutch plate 146 (FIG. 12). Additionally, the elongated portion of the camming member 156 is rotated out of alignment with a protuberance 180 on a bottom plate 160 within the lock 100. This movement allows a button portion 156' of the camming member 156 that extends through the lock housing 150 to be pressed to axially slide the pins 179 against the drive portion or clutch plate 146 and spring washer 182 (or other such spring member) for axial disengagement of the clutch plate 146 from a lug 181 of the first tumbler disc 161. Subsequent rotation of the dial 136 rotates the clutch plate 146 with respect to the first tumbler disc 161 for alignment of the lug 181 with one of several apertures 187 in the clutch plate 146 (FIG. 11), to provide for several code selecting orientations of the dial 136. Releasing the button portion 156' with the dial and clutch plate in this new code selecting orientation causes the spring washer 182 to force the lug 181 into engagement with a new aperture 187 in the clutch plate 146, such that different numbers on the combination dial 136 are associated with each of the successive rotational positions selected to effect unlocking alignment of the tumbler discs 161, 161'. When the key cylinder lug 147 is rotated back to the normal locked position, the spring washer 182 returns the clutch plate 146 and pins 179 to their normal positions, with the protuberance 180 aligning with the elongated portion of the camming member 156 to block depression of the button portion 156'.

Figure 13:
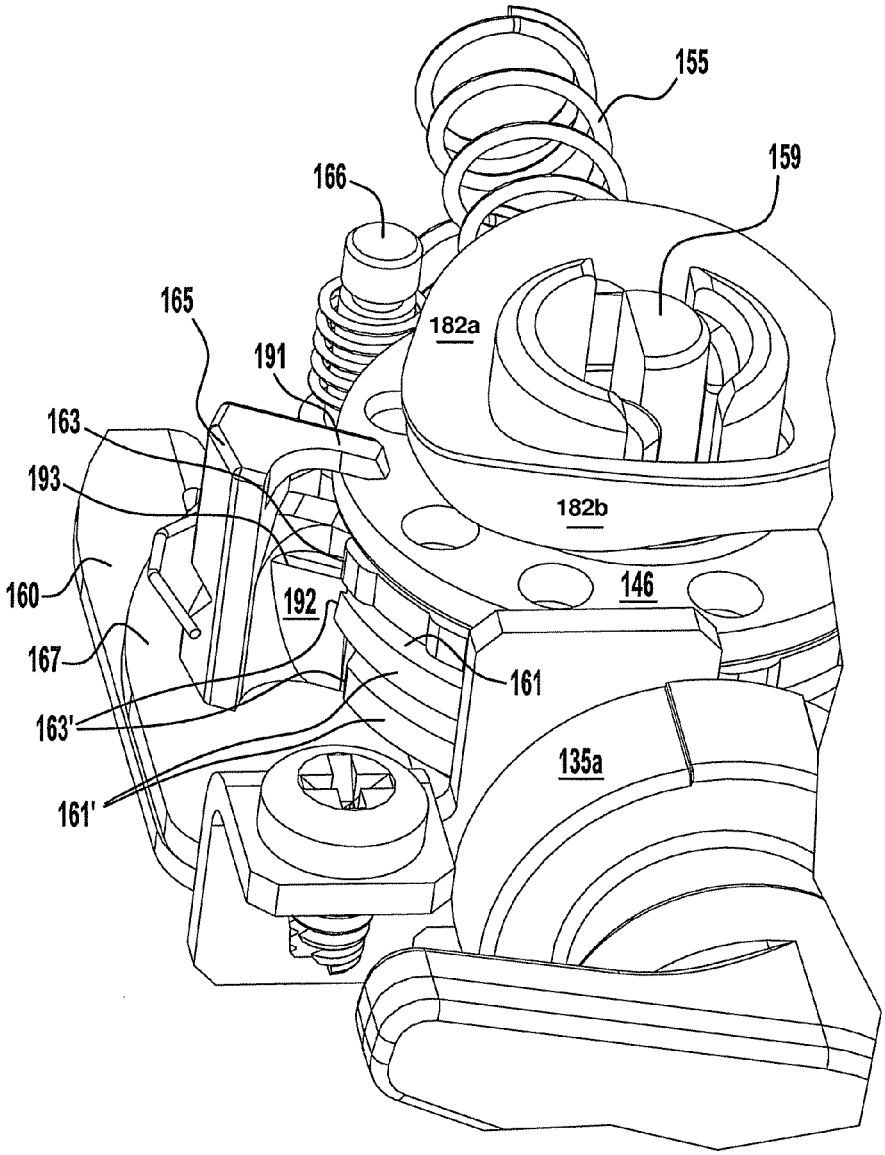
FIG. 13 is another partial perspective view of the locker lock of FIG. 8, with portions of the lock removed to illustrate additional features of the locker lock.
Figure 14:
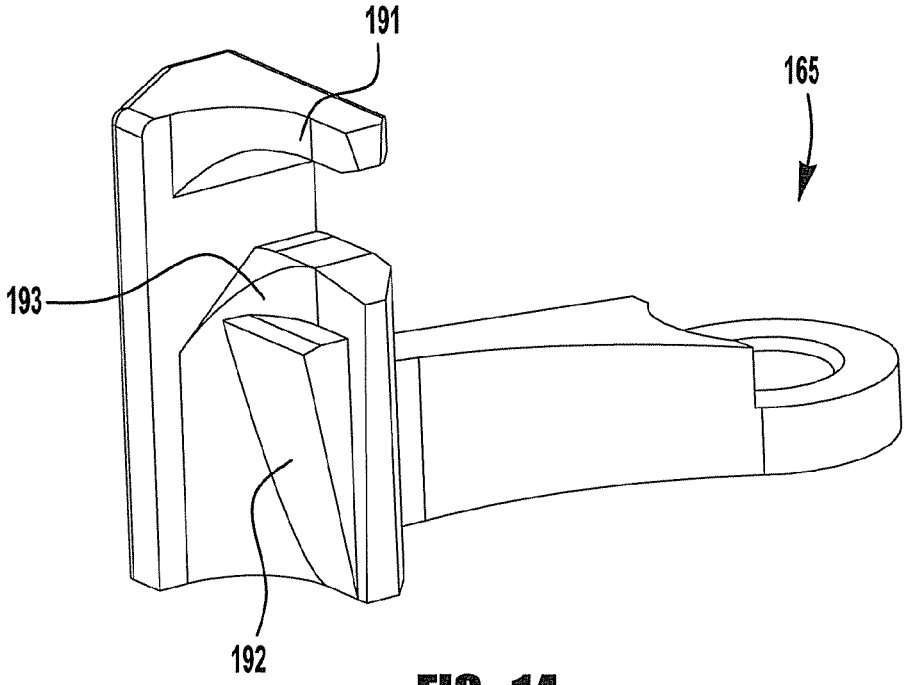
FIG. 14 is a perspective view of the lever of the locker lock of FIG. 8.

In the inventive embodiment, to prevent inadvertent separation of the clutch plate 146 from the innermost tumbler disc 161 during combination dial-operated movement of the locking bolt 135, the lever 165 is provided with a disc securing portion. The disc securing portion of the lever 165 engages the drive portion of the dial 136 and one or more of the tumbler discs 161, 161' to prevent axial disengagement of the first tumbler disc 161 from the clutch plate 146, for example, as a result of significant forces applied to the dial 136 during retraction of the locking bolt 135. While the disc securing portion may be provided in many suitable configurations, in the illustrated embodiment, a laterally extending retaining finger or other such disc securing portion 191 is positioned to overhang the clutch plate 146 when the lever 165 is pivoted to the notch engaging position. In this position, the retaining finger 191 axially restricts the clutch plate 146 to prevent inadvertent axial inward movement of the clutch plate (for, example, due to shifting or play of the clutch plate 146 or pivot pin 166, as described above). Further, the lever may include a flatted ledge 192 (best shown in FIG. 14) positioned to engage the notches 163' of the outermost and middle tumbler discs 161' (FIG. 13). The finger 191 and ledge 192 define a laterally extending recess 193 into which the notched portion 163 of the innermost tumbler disc 161 may be retained or captured. When the lever 165 is in the notch engaging position, the innermost tumbler disc 161 and the clutch plate 146 are effectively sandwiched or axially captured between the ledge 192 and the retaining finger 191 to prevent axial separation of the clutch plate 146 and tumbler disc 161.

To accommodate the overhang of the retaining finger 191 on the clutch plate 146, a modified clutch plate biasing arrangement may be utilized. As shown in FIG. 13, the illustrated embodiment uses two spring washers 182*a*, 182*b* each having a reduced outer diameter to provide clearance for the retaining finger 191.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A combination lock comprising:

a lock housing;

a locking mechanism assembled with the lock housing, the locking mechanism comprising a locking member moveable between a locking position and a releasing position, a locking lever connected to the locking member, and at least first and second tumbler discs rotatable about a post, wherein when each of the at least first and second tumbler discs is rotated to an unlocking orientation, the locking lever engages aligned recesses in the at least first and second tumbler discs for movement of the locking member from the locking position to the releasing position;

a dial secured to the lock housing for selective rotation of the at least first and second tumbler discs, the dial including a drive portion rotationally secured in interlocking engagement with the first tumbler disc in one of a plurality of code selecting orientations; and a camming member disposed in the lock housing, the camming member being operable in a code change condition to axially disengage the first tumbler disc from the drive portion of the dial, allowing for rotation of the dial with respect to the first tumbler disc and re-engagement of the dial with the first tumbler disc in another of the plurality of code selecting orientations;

wherein the locking lever includes a disc securing portion positioned to prevent axial disengagement of the first tumbler disc from the drive portion of the dial when the locking lever is engaged with the aligned recesses in the at least first and second tumbler discs.

2. The combination lock of claim 1, wherein the locking member comprises a laterally movable locking bolt.

3. The combination lock of claim 1, wherein the locking lever is pivotally biased against the at least first and second tumbler discs.

4. The combination lock of claim 1, wherein the camming member comprises a button extending outward of the lock housing.

5. The combination lock of claim 1, wherein the disc securing portion of the locking lever comprises a laterally extending recess.

6. The combination lock of claim 1, wherein the disc securing portion of the locking lever comprises a laterally extending finger portion.

7. The combination lock of claim 1, wherein the disc securing portion of the locking lever axially captures the dial drive portion and the first tumbler disc when the locking lever is engaged with the aligned recesses in the at least first and second tumbler discs.

8. The combination lock of claim 1, further comprising a spring member disposed between the dial drive portion and the lock housing to axially bias the dial drive portion toward the first tumbler disc.

9. A locker lock comprising:

a lock housing;

a locking mechanism assembled with the lock housing, the locking mechanism comprising a locking bolt laterally moveable between a locking position and a releasing position, a locking lever connected to the locking bolt, and first, second, and third tumbler discs rotatable about a post, wherein when each of the first, second, and third tumbler discs is rotated to an unlocking orientation, the locking lever pivots to engage aligned recesses in the first, second, and third tumbler discs, such that further rotation of the first, second, and third tumbler discs moves the locking bolt from the locking position to the releasing position;

a dial secured to the lock housing for selective rotation of the first, second, and third tumbler discs, the dial including a drive portion rotationally secured in interlocking engagement with the first tumbler disc in one of a plurality of code selecting orientations; and a camming member disposed in the lock housing, the camming member being operable in a code change condition to axially disengage the first tumbler disc from the drive portion of the dial, allowing for rotation of the dial with respect to the first tumbler disc and re-engagement of the dial with the first tumbler disc in another of the plurality of code selecting orientations;

wherein the locking lever includes a disc securing portion positioned to prevent axial disengagement of the first tumbler disc from the drive portion of the dial when the locking lever is engaged with the aligned recesses in the first, second, and third tumbler discs.

10. The locker lock of claim 9, wherein the camming member comprises a button extending outward of the lock housing.

11. The locker lock of claim 9, wherein the disc securing portion of the locking lever comprises a laterally extending recess.

12. The locker lock of claim 9, wherein the disc securing portion of the locking lever comprises a laterally extending finger portion.

13. The locker lock of claim 9, wherein the disc securing portion of the locking lever axially captures the dial drive portion and the first tumbler disc when the locking lever is engaged with the aligned recesses in the first, second, and third tumbler discs.

14. The locker lock of claim 9, further comprising a spring member disposed between the dial drive portion and the lock housing to axially bias the dial drive portion toward the first tumbler disc.

15. A combination locking arrangement comprising:

a locking member moveable between a locking position and a releasing position;

a locking lever connected to the locking member;

at least first and second tumbler discs rotatable about a tumbler disc axis, wherein when each of the at least first and second tumbler discs is rotated to an unlocking orientation, the locking lever engages aligned recesses in the at least first and second tumbler discs, such that further rotation of the at least first and second tumbler discs moves the locking member from the locking position to the releasing position; and a dial rotatable about the tumbler disc axis for selective rotation of the at least first and second tumbler discs, the dial including a drive portion rotationally secured in interlocking engagement with the first tumbler disc in one of a plurality of code selecting orientations;

wherein the locking lever includes a disc securing portion positioned to prevent axial disengagement of the first tumbler disc from the drive portion of the dial when the locking lever is engaged with the aligned recesses in the at least first and second tumbler discs.

16. The arrangement of claim 15, wherein the locking member comprises a laterally movable locking bolt.

17. The arrangement of claim 15, wherein the locking lever is pivotally biased against the at least first and second tumbler discs.

18. The arrangement of claim 15, wherein the disc securing portion of the locking lever comprises a laterally extending recess.

19. The arrangement of claim 15, wherein the disc securing portion of the locking lever comprises a laterally extending finger portion.

20. The arrangement of claim 15, wherein the disc securing portion of the locking lever axially captures the dial drive portion and the first tumbler disc when the locking lever is engaged with the aligned recesses in the at least first and second tumbler discs.

* * * * *